US005161510A

United States Patent [19]

Yamada

[11] Patent Number: 5,161,510

[45] Date of Patent: Nov. 10, 1992

[54] ELECTRICALLY OPERATED FUEL INJECTOR

[75] Inventor: Akira Yamada, Iwata, Japan

[73] Assignee: Yamaha Hatsudoki Kabushiki Kaisha, Iwata, Japan

[21] Appl. No.: 633,102

[22] Filed: Dec. 21, 1990

[30] Foreign Application Priority Data

Dec. 27, 1989 [JP] Japan ..... 1-343770

[51] Int. Cl.[5] ..... F02D 41/34; F02M 67/02

[52] U.S. Cl. ..... 123/494; 123/478; 123/531

[58] Field of Search ..... 123/494, 478, 531, 532, 123/533, 534, 305

[56] References Cited

U.S. PATENT DOCUMENTS

| | | | |
|---|---|---|---|
| 4,480,620 | 11/1984 | Tange et al. | 123/305 |
| 4,643,153 | 2/1987 | Clement et al. | 123/478 |
| 4,681,076 | 7/1987 | Müller | 123/478 |
| 5,020,504 | 6/1991 | Morikawa | 123/305 |

*Primary Examiner*—Andrew M. Dolinar
*Attorney, Agent, or Firm*—Ernest A. Beutler

[57] ABSTRACT

A fuel injection system for an internal combustion engine including a fuel injector that has an electric solenoid for its actuation that is powered by a battery. In the even the battery condition becomes depleted, the actuating pulse for the solenoid is advanced and extended in duration to accommodate the weakened state of the battery and maintain stable amount of fuel injection regardless of battery condition.

7 Claims, 5 Drawing Sheets

ELECTRICALLY OPERATED FUEL INJECTOR

BACKGROUND OF THE INVENTION

This invention relates to an electrically operated fuel injector and more particularly to an improved system for controlling an electrically operated fuel injector.

The advantages of fuel injection for improving engine performance are well know. Many popular types of fuel injectors employ solenoid operated devices for controlling the beginning and ending of the fuel injection. For example, in an accumulator type of fuel injector, there is a solenoid that opens and closes a relief valve to successively dump the pressure in a control chamber and cause the injector valve to open and the accumulator chamber to discharge into the engine. Although these devices are extremely successful, they do have one disadvantage.

When the electrical power source becomes weak, for example, if the battery is less than fully charged, the reduced voltage and current available for operating the solenoid can cause a delay in the opening and/or closing of the solenoid. This will effect not only the timing of the injection, but also the amount of fuel injected. As a result, the condition of weak electrical power can adversely effect the operation of the fuel injector.

It is, therefore, a principal object of this invention to provide an improved, electrically operated fuel injector.

It is a further object of this invention to provide an electrically operated fuel injector that will provide adequate and correct fuel injection regardless of the condition of the electrical power source.

SUMMARY OF THE INVENTION

This invention is adapted to be embodied in a fuel injector for an internal combustion engine that includes an electrically controlled element for controlling the timing of fuel injection and an electrical power source for operating the electrically controlled element. In accordance with the invention, means detect the condition of the electrical power source and adjust the operation of the electrically operated device to compensate for reduced electrical power.

A further feature of the invention is adapted to be embodied in a method for operating an electrically controlled fuel injector from an electrical power source. In accordance with this method, the condition of the electrical power source is determined and the control of the fuel injector is adjusted to compensate for reduced electrical power levels.

DETAILED DESCRIPTION OF THE PREFERRED EMBODIMENTS OF THE INVENTION

Figure 1:
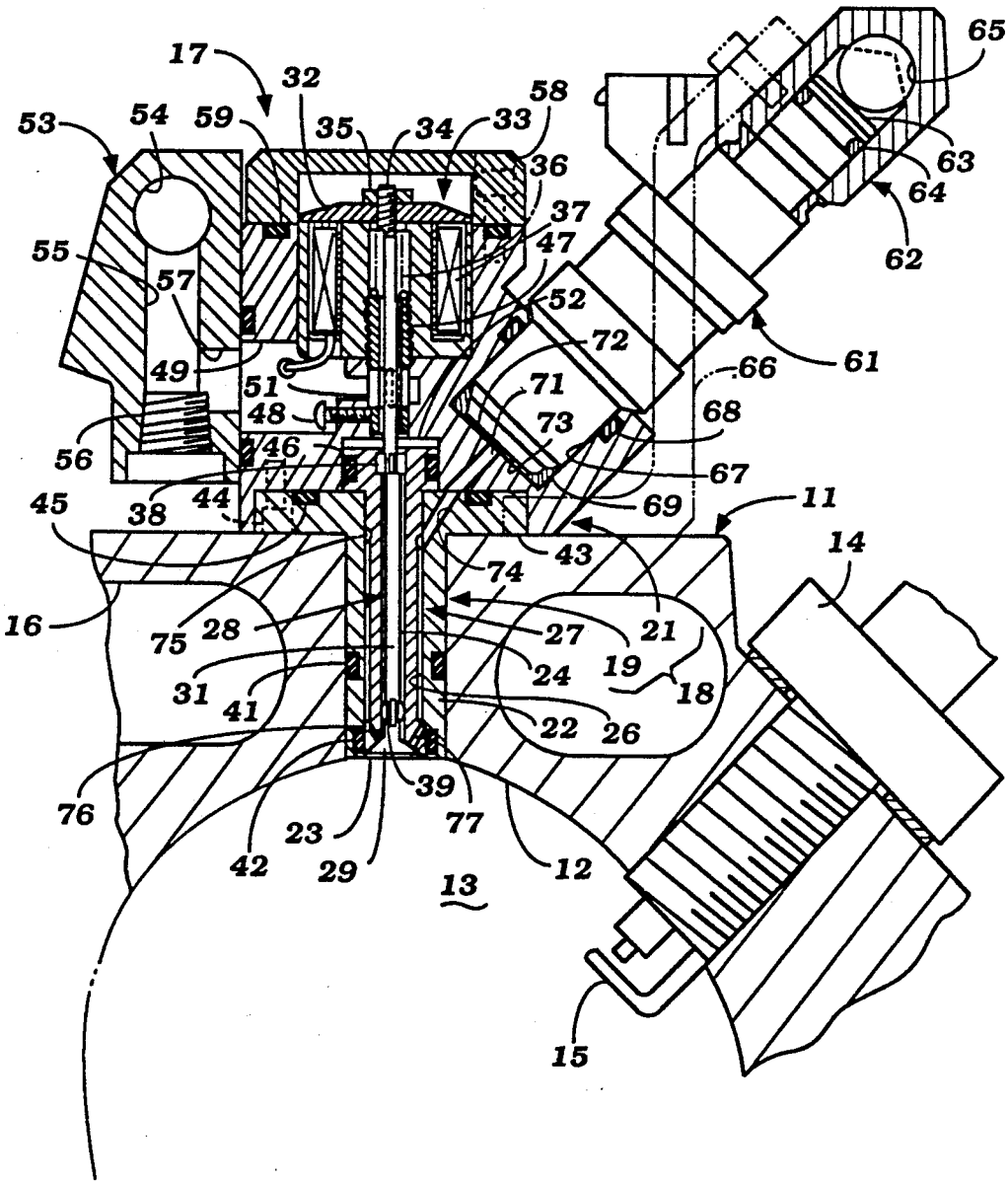
FIG. 1 is a partial cross sectional view taken through the combustion chamber of an engine having a fuel injection system constructed and operated in accordance with embodiments of the invention.

Referring first to FIG. 1, a portion of an internal combustion engine having a fuel injection system constructed and operated in accordance with the invention is partially depicted. Since the invention deals with the fuel injection system, illustration of the complete engine is not believed to be necessary in order to understand the construction and operation of the invention.

The engine depicted is of the two cycle crankcase compression type. Although the invention may be employed in conjunction with four cycle engines, it has particular utility in conjunction with two cycle engines.

The engine includes a cylinder head 11 which has a recess 12 which defines partially a combustion chamber 13. The combustion chamber 13 is defined by the cylinder head recess 12, the head of the piston and the cylinder bore (not shown). A spark plug 14 is threaded into the cylinder head 11 and has its gap 15 disposed appropriately in the combustion chamber 13. A cooling jacket 16 is formed in the cylinder head 11 and coolant is circulated through this cooling jacket in a known manner for engine cooling.

A fuel injector, indicated generally by the reference numeral 17, is mounted within a bore 18 formed in the cylinder head 11. In the illustrated embodiment, the injector 17 is a fuel/air injector. It is to be understood, however, that the invention may be employed with other types of fuel injectors than air/fuel injectors. For example, the invention may be utilized with injectors that inject only fuel, but the invention has particular utility in conjunction with air/fuel injectors.

The injector 17 includes a housing assembly, indicated generally by the reference numeral 18, which is comprised of a lower housing piece 19 and an upper housing piece 21. The lower housing piece 19 has a cylindrical portion 22 that is received within a suitable bore formed in the cylinder head 11 and terminates at a nozzle portion 23. The nozzle portion 23 is formed by an insert, indicated generally by the reference numeral 24, which has a cylindrical portion 25 that is disposed radially inwardly of a bore 26 formed in the cylindrical portion 22 of the lower housing portion piece 19. This forms a chamber 27 to which fuel is delivered, in a manner to be described. The nozzle opening 23 is formed by an enlarged diameter portion of the insert 24.

An injection valve, indicated generally by the reference numeral 28, has a head portion 29 that cooperates with the nozzle seat 23 so as to open and close it. The injection valve 28 has a reduced diameter portion 31 that extends through a bore in the insert piece 24 and which is connected at its upper end to an armature plate 32 of a solenoid assembly, indicated generally by the reference numeral 33. The upper end of the valve stem 31 is threaded as at 34 so as to receive a nut 35 to provide an adjustable connection to the armature plate 32.

A coil compression spring 36 acts against the armature plate 32 and urges the injection valve 28 to its normal closed position as shown in the drawing. A solenoid winding 37 encircles the upper end of the vale stem 31 and when energized will attract the armature plate 32 downwardly to compress the spring 36 and open the injection valve 28.

The valve stem 31 is provided with upper and lower extension lugs 348 and 39 that slidably engage the bore in the insert piece 24 so as to support the valve 28 for its reciprocal movement without interfering with the air flow therepast.

The cylindrical portion 22 of the housing piece 19 is formed with one or more annular grooves in which an O ring seal 41 is provided for sealing with the cylinder head 11. In a like manner, its internal surface is formed with an annular groove so as to receive an O ring seal 42 which seals with the enlarged end of the insert 24.

The housing piece 19 has an enlarged flange 43 formed at its upper end which is received within a counterbore formed in the lower face of the housing piece 21. Socket headed screws 44 affixed the housing pieces 19 and 21 to each other and an O ring seal 45 provides a seal between these pieces. The insert piece 22 has an enlarged headed portion 46 that is received within a bore formed in the housing piece 21 at the base of the counterbore which receives the flange 43 of the housing piece 19. Above this bore, the housing piece 21 is provided with a further bore that receives a sleeve 47 that is threaded to the core of the solenoid winding 37 and against which the coil compression spring 36 bears. This sleeve 47 provides a combined mounting function for the winding 37 and preload adjustment for the spring 36. The sleeve 47 is held in position by means of a lock screw 48 which is threaded through the housing piece 21 and which is accessible through an opening 49 formed in the side thereof. The opening 49 also admits air, in a manner to be described, which can flow through a slotted opening 51 in the sleeve 47 so as to be received in a gap 52 formed around the valve stem 31 and the interior of the insert piece 24.

The air is delivered to the opening 49 from an air manifold, indicated generally by the reference numeral 53, and which is affixed to the injector body. The air manifold 53 has a transversely extending passage 54, one end of which is connected to a regulated source of air pressure (not shown). The bore 54 is intersected by a crossbore 55, the outer end of which is closed by a plug 56. The manifold 53 is further provided with intersecting passages 57 which communicate with the opening 49 in the housing piece 21 so as to permit air under pressure to enter the aforenoted chamber 52.

Air leakage from around the solenoid 33 is precluded by means of a cap 58 that is affixed to the upper end of the housing piece 21 and which engages an O ring seal 59.

A fuel injector 61 is provided for the injector 17. The fuel injector 61 may be of any known type. Fuel is delivered to the fuel injector 61 by a fuel manifold 62 that is affixed to the tip 63 of the fuel injector 62 and which is sealed thereto by O ring seals 64. A manifold line 65 which communicates with a regulated pressure fuel source (not shown) delivers the fuel to the fuel injector 61. The fuel manifold 62 is mounted on a mounting bracket that is shown in phantom and which is identified by the reference numeral 66.

For ease of location, the housing piece 21 is formed with a bore 67 that is disposed at approximately a 45° angle to the axis of the injector valve 28. The bore 67 receives the nozzle portion of the injector 61. O ring seals 68 and 69 provide a sealing function around these nozzle portions so that the fuel which issues from the injector 61 will be directed toward a passage 71 bored into the housing piece 21. The passage extends from the bore 67 and specifically from a shoulder 72 formed at the base of this bore 67. The fuel injector nozzle end portion 73 is spaced slightly from the shoulder 72 so as to provide a chamber through which the fuel will be injected. By using this close spacing, no significant dead space exits between the injector nozzle and the passage 71. Dead space will be eliminated and better fuel injection control can be obtained.

The housing piece passage 71 is intersected by corresponding passage 74 formed in the housing piece 21. These passages terminate in an annular recess 75 formed in the periphery of the insert 24 so as to communicate the fuel with the chamber 27. At the lower end of the chamber 27, there is provided another annular relief 76 that is intersected by a plurality of ports 77 that extend through the lower end of the enlargement of the insert piece 24 at the valve seat 23. Hence, when the valve head 29 moves to its open position, both fuel and air will be valved into the combustion chambers 13.

It is to be understood that the amount of fuel injected can be varied in a wide variety of manners and the operation of the fuel injector 61 may be initiated either before the valve 28 is opened or after. Any such control strategies are within the spirit and scope of the invention. Also, the air pressure delivered to the port 54 can also be varied as desired so as to change the fuel/air injection characteristics. Again, this particular part of the strategy is not critical to the invention and the invention may be utilized in conjunction with any wide variety of strategies of varying air pressure and/or the timing and duration of operation of the injector 17.

Basically, the way the injector 17 operates is that air under pressure is always supplied by the manifold 53 and fuel is injected at a desired timing by the injector 61 into the chamber 27. The fuel and air will then be discharged into the combustion chamber 13 when the solenoid 33 and specifically its winding 37 is energized and the injection valve 28 is opened. As used in the specification and claims hereinafter, the term "initiation of injection" will be referred to as the time when the injection valve 28 is opened. This assumes that fuel will be supplied to the combustion chamber 13 at that time. This fuel may or may not have been precharged into the chamber 27 depending upon the specific control strategy. It may be that the fuel is supplied by the injector 61 simultaneously with opening of the injection valve 28.

Figure 2:
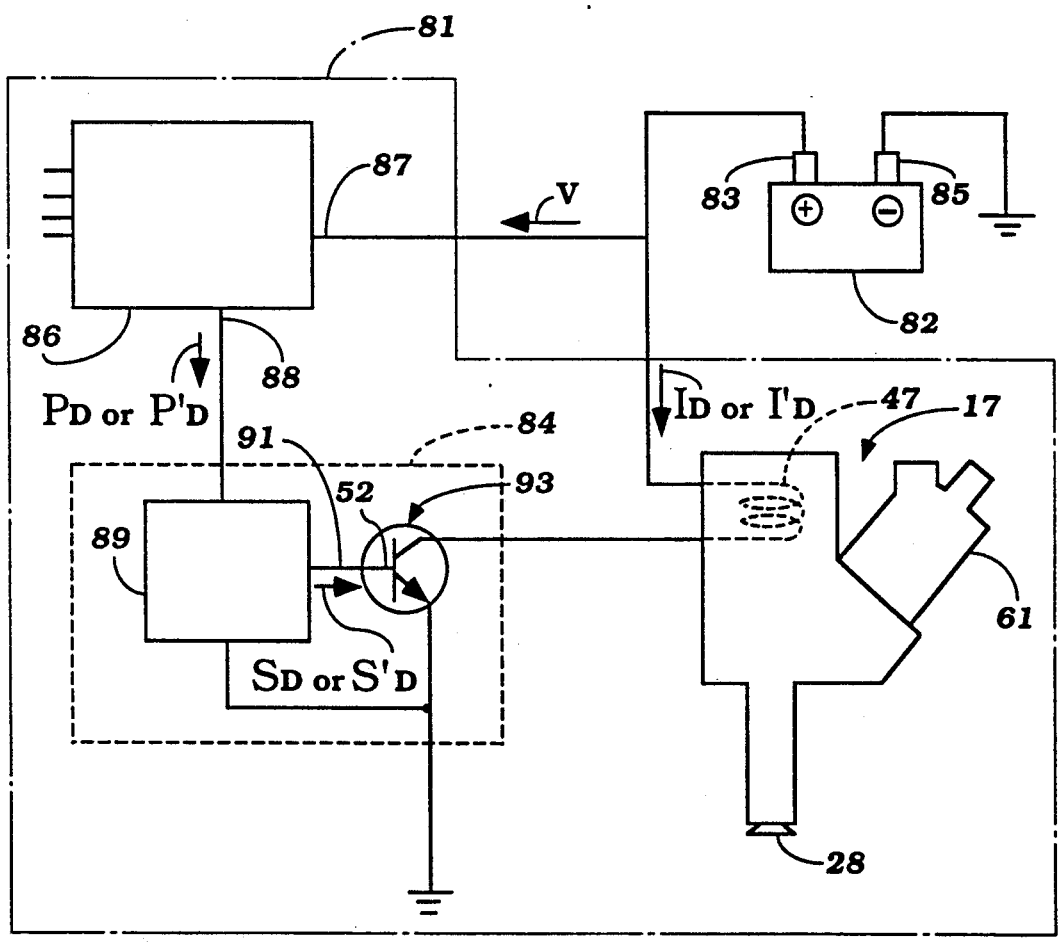
FIG. 2 is a schematic view showing the components of the injection control system.

FIG. 2 illustrates in a somewhat schematic fashion the electrical power source and activating circuit for energizing the solenoid 47 and initiating the opening of the injection valve 28. The control and actuating circuit is indicated generally by the reference numeral 81 in phantom and controls the supply of electrical power from a battery 82 to the solenoid coil 47. The battery 82 has its positive terminal 83 in circuit with the solenoid winding 47 and a solenoid actuating circuit, indicated generally by the reference numeral 84, which will complete the circuit to ground when switched on. The battery 82 has its negative terminal 85 also grounded so that the circuit will be completed when the other terminal of the solenoid 47 is grounded.

A control unit 86 receives a voltage signal v from the battery 82 via a conductor 87. The control unit 86 then outputs a control pulse $P_D$ or $P_{D'}$ through a conductor 88 to a control circuit 89. The control circuit 89 in turn, outputs a signal $S_D$ or $S'_D$ through a conductor 91 to the gate 92 of a transistor 93, which acts as a switch for completing the circuit through the winding 47.

Figure 3:
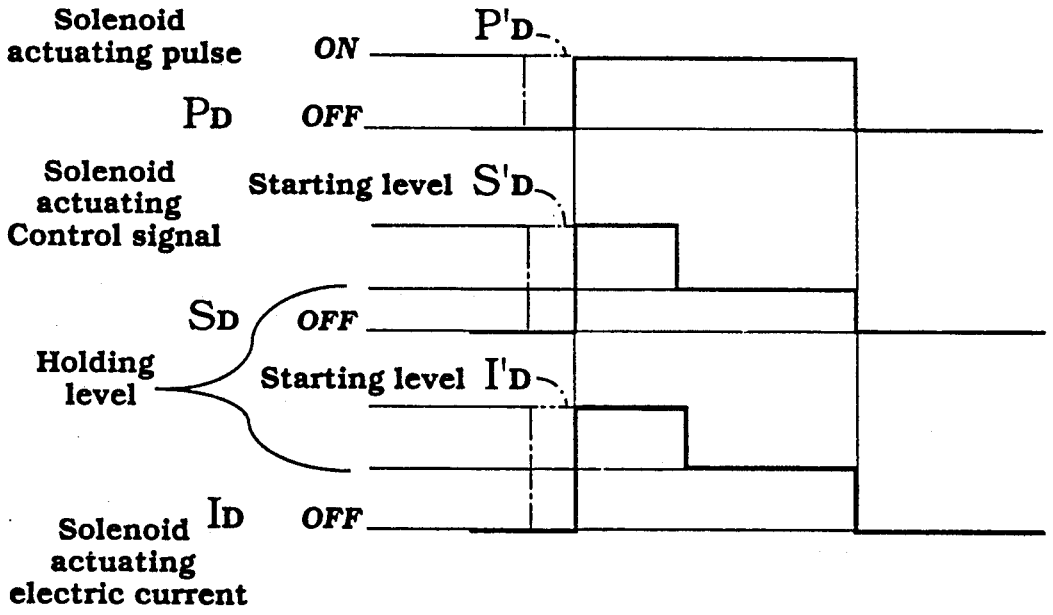
FIG. 3 is a graphic view showing the solenoid actuating pulse, solenoid actuating control signal and solenoid actuating current in conjunction with one embodiment of the invention.
Figure 4:
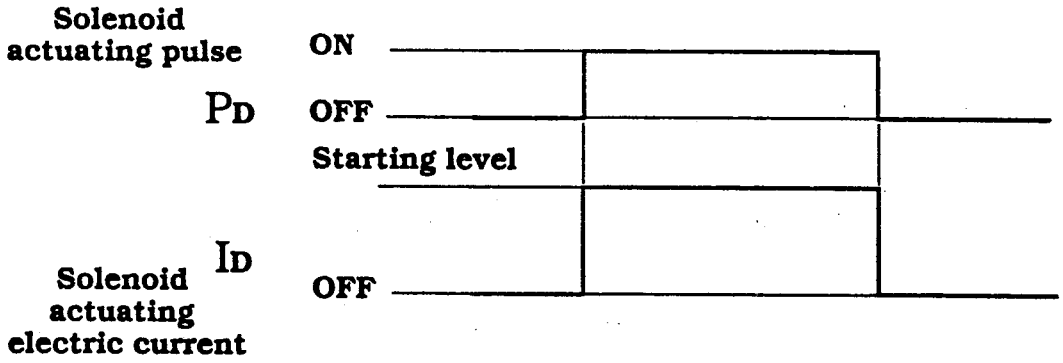
FIG. 4 is a graphic view showing the solenoid actuating pulse and solenoid actuating electrical current in accordance with another embodiment of the invention.

FIG. 3 is a graphic view showing the solenoid actuating pulse ($P_D$), solenoid actuating control signal ($S_D$) and solenoid actuating electrical current ($I_D$). In these embodiments, the solenoid actuating control signal is a stepped signal which has a higher level starting signal that results in a higher level electric starting current and then drops to a lower level signal and current after the valve has begun opening. This is because a greater current is required in order to initiate the opening of the valve 28 than to hold it in its open position. Of course, such a holding arrangement need not be employed and FIG. 4 shows an arrangement wherein only a single actuating pulse and constant current are supplied to the solenoid 47.

Figure 5:
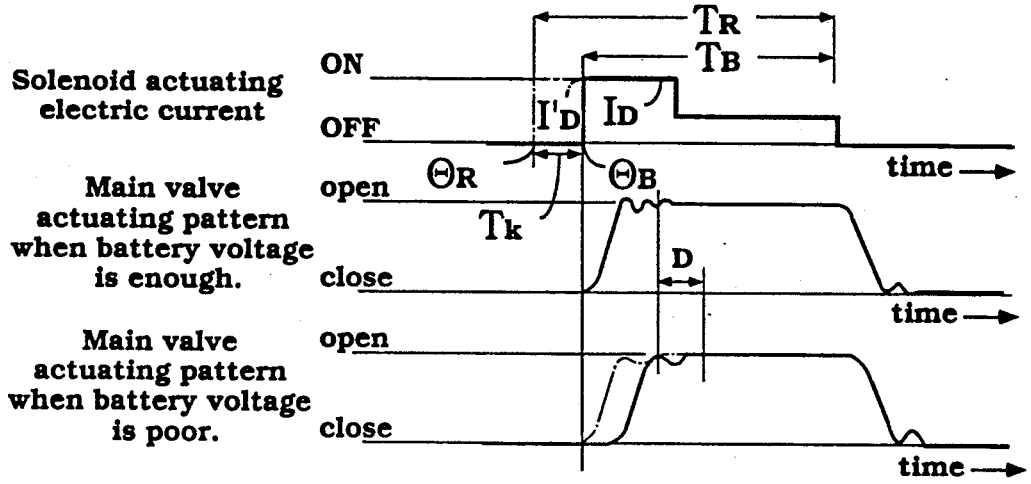
FIG. 5 is a view showing the relationship of the solenoid actuating current to the valve operation in relation to time in accordance with the embodiment of FIG. 3.
Figure 6:
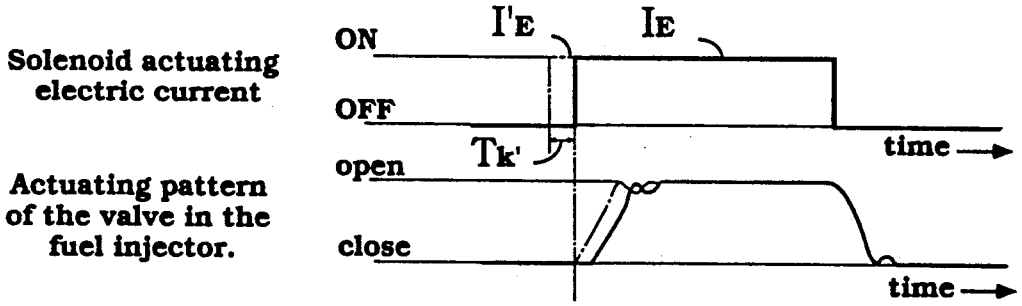
FIG. 6 is a graphic view showing the solenoid actuating current of the fuel injector and valve movement.

Referring now to FIGS. 5 and 6, the solenoid actuating current is shown graphically in relation to time along with the actual valve opening. As may be seen from the curve $B_1$, when the solenoid actuating current is turned on, the valve 28 moves open rapidly, but there is some bouncing at the end of the initial opening. After the starting current is dropped to the holding current, the valve 28 will still remain fully opened until the current discontinues and then the valve 28 will close, again with some bouncing operation. This assumes full battery charge and high voltage. However, as the battery becomes depleted and the voltage falls, then the curve B results, which means there is a delay in the opening of the injection valve by a time span D. Accordingly, when this condition is sensed, then the solenoid actuating current is switched on earlier by a time $T_K$ to advance the crank angle at which the actuating pulse initiates from the point $\theta_B$ to the point $\theta_R$. The current shut off time is the same because the valve will close at the same rate regardless of the condition of the battery. Therefore, the duration of the solenoid pulse is longer, as shown by the dimension $T_R$ than the normal $T_B$ time period.

The same condition exists with respect to the fuel injector 61 if it is electrically actuated and the relative actuating curves and valve openings for the injector are shown in FIG. 6. However, since the fuel injector has less inertia, the advance time $T_K$, for the fuel injector 61 can be lesser than that for the solenoid 43.

Figure 7:
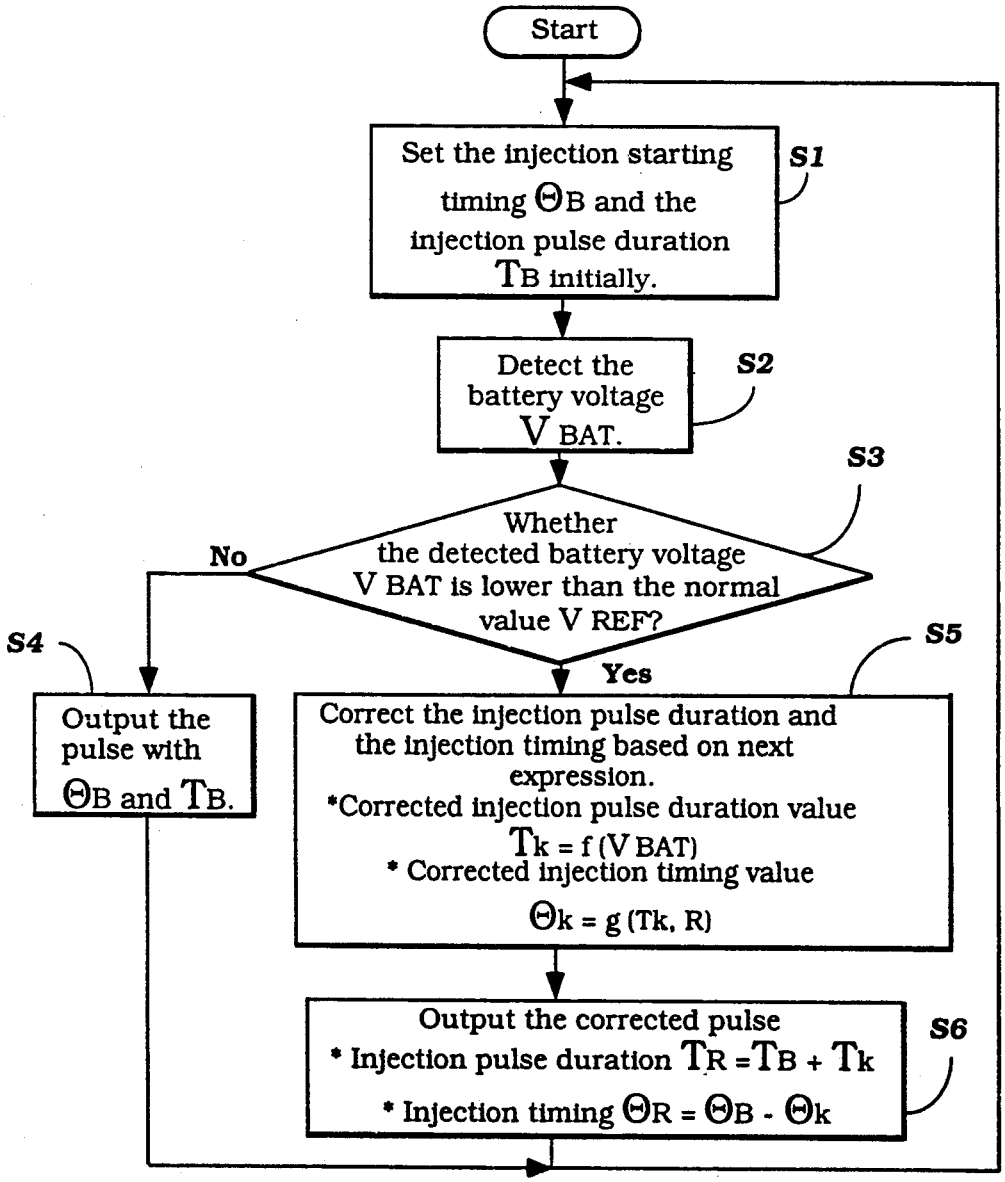
FIG. 7 is a block diagram showing the control routine in accordance with the invention.

The control routine may be understood by reference to FIG. 7. When the program starts, it moves to the step S1 so as to set the injection starting point $\theta_B$ and injection pulse duration $T_B$ based upon the running condition of the engine. The program then moves to the step S2 to determine the voltage of the battery, $V_{BAT}$. This sensed voltage is then compared with a reference voltage $V_{REF}$ which indicates the value at which the battery voltage is lower than the normal value $V_{REF}$. If the battery voltage is not less than this reference voltage, the program moves to the step S4 so as to output the originally set pulse and width for duration of injection $\theta_B$ and $T_B$.

If, however, the program determines at the step S3 that the battery voltage is lower than the reference voltage at which normal valve operation will occur, the program moves to the step S5 so that the control circuit 89 (FIG. 2) advances the point when the transistor 93 is switched. A calculated time correction for battery voltage $T_K=f(V_{BAT})$ is made and a correction of $\theta_K$ for timing advance is made from the calculation $\theta_K=g(T_K, R)$. The characters f and g are functions programmed into the control. The program then moves to the step S6 to correct the outputted pulse duration of injection timing $T_R=T_B+T_K$ and injection timing advance $\theta_R=\theta_B-\theta_K$ and this pulse is outputted then to the transistor 93 to switch it and create the opening of the injector valve 28. Similar corrections will be made for the fuel injector 61 if desired.

It should be readily apparent from the foregoing description that the described fuel injection system permits the use of an electrically activated fuel injector without having adverse effects of injection timing and duration due to a depleted battery voltage. Of course, the foregoing description is that of a preferred embodiment of this invention. Various changes and modifications may be made without departing from the spirit and scope of the invention, as defined by the appended claims.

I claim:

1. A fuel injection system for an internal combustion engine comprised of a fuel injector, an electric solenoid for actuating said fuel injector, a battery for providing electrical power for actuating said electrical solenoid, and means for detecting the condition of said battery to be depleted when battery voltage is below a predetermined value and for advancing the actuation of said solenoid in the event the battery condition is sensed to be depleted.

2. A fuel injection system as set forth in claim 1 wherein the means for actuating the solenoid also increases the time the actuating pulse is delivered to the solenoid when the battery condition has been depleted.

3. A air/fuel injection system comprising chamber means, means for delivering air under pressure to said chamber means, a fuel injector for supplying fuel to said chamber means, a valve for controlling the communication of said chamber means with an associated engine, a solenoid for operating said valve, a battery for providing electrical power for actuating said solenoid, and means for detecting the condition of said battery to be depleted when battery voltage is below a predetermined value and for advancing the actuation of said solenoid in the event the battery condition is sensed to be depleted.

4. A fuel injection system as set forth in claim 3 wherein the fuel injector for the air fuel injector also is operated by an electrical solenoid and the means for adjusting the energization of the solenoid for the injector valve also adjusts the actuation of the solenoid for the fuel injector.

5. A fuel injection system as set forth in claim 4 wherein the means for operating the valve solenoid advances the time an actuating pulse is delivered to the valve solenoid when the battery condition has been depleted.

6. A fuel injection system as set forth in claim 4 wherein the means for actuating the valve solenoid increases the time the actuating pulse is delivered to the valve solenoid when the battery condition has been depleted.

7. A fuel injection system as set forth in claim 6 wherein the means for operating the valve solenoid advances the time an actuating pulse is delivered to the valve solenoid when the battery condition has been depleted.

* * * * *